US011228112B2

(12) United States Patent
Holter

(10) Patent No.: US 11,228,112 B2
(45) Date of Patent: Jan. 18, 2022

(54) ELECTRICALLY CONTROLLED BROADBAND GROUP ANTENNA

(71) Applicant: SAAB AB, Linköping (SE)

(72) Inventor: Henrik Holter, Saltsjö-Boo (SE)

(73) Assignee: SAAB AB, Linköping (SE)

( * ) Notice: Subject to any disclaimer, the term of this patent is extended or adjusted under 35 U.S.C. 154(b) by 27 days.

(21) Appl. No.: 16/628,842

(22) PCT Filed: Jun. 20, 2018

(86) PCT No.: PCT/SE2018/050670
§ 371 (c)(1),
(2) Date: Jan. 6, 2020

(87) PCT Pub. No.: WO2019/009786
PCT Pub. Date: Jan. 10, 2019

(65) Prior Publication Data

US 2020/0136260 A1 Apr. 30, 2020

(30) Foreign Application Priority Data

Jul. 6, 2017 (SE) ..... 1750891-2

(51) Int. Cl.
*H01Q 13/08* (2006.01)
*H01Q 21/00* (2006.01)
(Continued)

(52) U.S. Cl.
CPC ..... *H01Q 13/085* (2013.01); *H01Q 5/50* (2015.01); *H01Q 21/0006* (2013.01);
(Continued)

(58) Field of Classification Search
CPC .. H01Q 13/085; H01Q 21/064; H01Q 21/061; H01Q 21/24; H01Q 21/06;
(Continued)

(56) References Cited

U.S. PATENT DOCUMENTS 6,891,511 B1 5/2005 Angelucci
7,057,570 B2 * 6/2006 Irion, II ..... H01P 5/10 343/725

(Continued)

FOREIGN PATENT DOCUMENTS

WO 2004006388 A1 1/2004
WO 2017095832 A1 6/2017

OTHER PUBLICATIONS

International Search Report and Written Opinion in corresponding International Application No. PCT/SE2018/050670 dated Sep. 3, 2018 (9 pages).
Extended European Search Report in corresponding European Application No. 18828092.9 dated Mar. 2, 2021 (10 pages).

*Primary Examiner* — Vibol Tan
(74) *Attorney, Agent, or Firm* — Sage Patent Group

(57) ABSTRACT

A broadband group antenna, comprising a plurality of antenna elements and an earth plane element, wherein the antenna elements are arranged in a common plane on top of the earth plane element and connected to a microwave transceiver unit via conductors provided in channels that extend through the earth plane element in a direction perpendicular to a main extension plane of the earth plane element, the antenna elements are arranged in a matrix pattern comprising first rows extending in a first direction and second rows extending in a second direction perpendicular to said first direction, wherein the antenna elements are in alignment with each other in said first rows and in said second rows.

12 Claims, 5 Drawing Sheets

(51) Int. Cl.

| | |
|---|---|
| ***H01Q 21/06*** | (2006.01) |
| ***H01Q 5/50*** | (2015.01) |
| ***H01Q 21/24*** | (2006.01) |
| ***H01Q 25/00*** | (2006.01) |

(52) U.S. Cl.
CPC ..... *H01Q 21/0087* (2013.01); *H01Q 21/06* (2013.01); *H01Q 21/061* (2013.01); *H01Q 21/24* (2013.01); *H01Q 25/001* (2013.01)

(58) Field of Classification Search
CPC ..... H01Q 9/28; H01Q 13/08; H01Q 13/106; H01Q 1/36; H01Q 1/38; H01Q 5/30

See application file for complete search history.

(56) References Cited

U.S. PATENT DOCUMENTS

| | | | | |
|---|---|---|---|---|
| 7,408,518 | B2 * | 8/2008 | Minard | H01Q 1/2275 343/700 MS |
| 7,616,169 | B2 * | 11/2009 | Holter | H01Q 21/06 343/844 |
| 8,350,773 | B1 | 1/2013 | Kindt | |
| 8,736,505 | B2 * | 5/2014 | Lambert | H01Q 21/064 343/770 |
| 9,318,811 | B1 | 4/2016 | Fluhler | |
| 9,472,860 | B1 | 10/2016 | Wiser | |
| 9,806,432 | B2 * | 10/2017 | Little | H01Q 1/50 |
| 2005/0088353 | A1 | 4/2005 | Irion et al. | |
| 2005/0285808 | A1 * | 12/2005 | Holter | H01Q 13/085 343/754 |

* cited by examiner

Prior Art

Fig. 3,

ELECTRICALLY CONTROLLED BROADBAND GROUP ANTENNA

CROSS-REFERENCE TO RELATED APPLICATIONS

This application is a U.S. National Stage application of PCT/SE2018/050670, filed Jun. 20, 2018 and published on Jan. 10, 2019 as WO 2019/009786, which claims the benefit of Swedish Patent Application No. 1750891-2, filed Jul. 6, 2017, all of which are hereby incorporated by reference in their entireties.

TECHNICAL FIELD

The present invention relates to an electrically controlled broadband group antenna comprising:

a plurality of antenna elements, and an earth plane element, wherein the plurality of antenna elements are arranged in a common plane and configured to be electrically connected to a microwave transceiver unit via conductors provided in channels that extend through the earth plane element in a direction perpendicular to a main extension plane of the earth plane element, the antenna elements are arranged in a matrix pattern comprising first rows extending in a first direction and second rows extending in a second direction perpendicular to said first direction, wherein the antenna elements are in alignment with each other in said first rows and in said second rows, and wherein, from an area of each of a plurality of antenna elements of one first row there is provided a first conductor that extends from a bottom side of the earth plane element through a first of said channels, and continues in a third direction parallel to the main extension plane of earth plane element to an area of a first neighbouring antenna element belonging to the same first row as each of said plurality of antenna elements, for the feeding of that first neighbouring antenna element, and a second conductor that extends from a bottom side of the earth plane element through a second of said channels and continues in a fourth direction parallel to the main extension plane of earth plane element to an area of a second neighbouring antenna element belonging to the same second row as the antenna element from which the first and second conductors extend, for the feeding of that second antenna element.

BACKGROUND ART

Electrically controlled broadband group antennas with an instantaneous bandwidth larger than one octave are known, and are used in for example military telecommunication systems and multifunction radar.

An electrically controlled broadband group antenna as defined hereinabove is disclosed in the present applicant's patent application WO 2004/006388. Each antenna element of the antenna disclosed in WO 2004/006388 comprises a rotational-symmetrical body. The axis of rotation of each of said rotational-symmetrical bodies is essentially perpendicular to a main extension plane of an earth plane element, and each of said rotational-symmetrical bodies, at the end furthest away from the earth plane element, is shaped so that it tapers towards its axis of rotation with increasing distance from the earth plane element and is provided with a metallic casing surface. This kind of antenna element is also known as a BOR antenna element, and the antenna is known as a BOR antenna (wherein BOR represents Body Of Revolution).

Normally, the BOR antenna element is equipped with a central bolt that extends from a bottom surface of the antenna element and is configured to be screwed into a corresponding hole provided in the earth plane element on which the antenna element is to be attached. Each antenna element is fed with double polarized RF-signals in accordance with well-established principles. Thereby, two feeding conductors are connected to each antenna element at positions angularly set off by 90° relative to each other. Each conductor extends from a contact at the back side of the earth plane element through a channel which is perpendicular to the extension plane of the earth plane element. The channel extends to the upper surface of the earth plane element to an area of an antenna element, but not the antenna element to be fed by the conductor of that channel, but to a neighbouring antenna element. At the upper surface of the earth plane element the channel changes direction with 90° and continues in the shape of groove at the upper surface of the earth plane element in a direction towards a neighbouring antenna element that is to be fed by means of an electric conductor provided in said channel. In the area of another antenna element, which is also a neighbour to the antenna element to be fed, but located 90° set off relative the first neighbouring element from which the first feeding conductor will extend, a corresponding channel and groove is provided, through which a second conductor for feeding of that same antenna element will extend. From each area of an antenna element, as a consequence of the above-described design, two conductors will thus extend through a respective channel and groove to a respective neighbouring antenna element to be fed. The grooves are perpendicular to each other.

The area of the respective antenna element, as referred to herein, is an area below the respective antenna element covered by the antenna element when the latter is mounted on the earth plane element. Due to the above-described design, and to the presence of the bolt by means of which the antenna is attached to the earth plane element, one of the two channels extending through the earth plane element in the region of one antenna element will be set off relative a line along which the antenna elements of a row of antenna elements is in alignment. This means that every second channel of such a row will be set off, and that the contacts on the back side of that row of antenna elements will not be in alignment, but will be arranged in a zigzag pattern. This, in its turn, means that the feeding module (microwave transceiver unit), which is provided with corresponding contacts to be connected to the contacts on the earth plane element, will present a corresponding zigzag pattern of contacts for each row of antenna elements. Thereby the feeding module becomes more complicated to produce and space-requiring.

It is an object of the present invention to present a broadband antenna design that, compared to prior art design, enables a reduction of the thickness of microwave transceiver unit connected to the backside of the earth plane element of the broadband antenna.

SUMMARY OF THE INVENTION

The object of the invention is achieved by means of the broadband antenna according to the preamble of claim 1, cited hereinabove, which is characterised in that at least one of the third and fourth directions is non-parallel with the first and second directions (y, x) respectively, and that the first and second channels via which the first and second conductors of each of said plurality of antenna elements of said one first row are configured to be connected to a microwave transceiver unit are in alignment with each other along a line, which is parallel with said first direction. This means that there is no zigzag pattern at all for those channels, and that the contacts on the backside of the earth plane element associated to the channels of a row of antenna elements are in alignment in said first direction. Thereby, the thickness of a microwave transceiver unit connected to said contacts can be further reduced. The third direction is compared to the first direction and the fourth direction is compared to the second direction. Preferably, the term broadband group antenna as referred to herein is defined as an antenna having a fractional band width of at least 20%.

According to prior art, the third and fourth directions have been parallel to the first and second directions respectively. By leaving that principle, for the principle of the present invention, it will be possible to move the channels closer to a common line, which is parallel with said first direction. Accordingly, they may still be in a zigzag pattern, but the zigzag pattern may occupy a narrower path, thereby resulting in a possibly thinner microwave transceiver unit. The solution according to the invention is particularly advantageous in those cases when the antenna element is a BOR antenna with a central bolt that will normally set the limits for how narrow the path occupied by the zigzag pattern can be. Preferably, the channels continue in said third and fourth directions as grooves provided in an upper surface of the earth plane element or a spacing element provided thereon. Preferably, in said channels the conductors are electrically isolated from the surrounding earth plate element. Preferably, the conductors are coaxial cables. Preferably, each antenna element is fed with double polarized RF-signals in accordance with well-established principles. Thereby, two feeding conductors are connected to each antenna element at positions angularly set off by 90° relative to each other as seen in the direction of a rotational axis of the BOR antenna.

According to a preferred embodiment, the third direction is non-parallel with the first direction (y) and the fourth direction is non-parallel with the second direction (x).

According to one embodiment, the term "non-parallel" as referred to hereinabove or hereinafter me be defined as "an angle of at least 5°".

It is preferred that the respective conductor extends rectilinearly in said third and fourth directions respectively.

According to one embodiment, the angle between the first direction and the third direction and/or between the second direction and the fourth direction is at least 5°. In other words, if there is non-parallelity between any of said directions, the angle is at least 5°.

According to one embodiment, the angle between the first direction and the third direction and/or between the second direction and the fourth direction is below 75°. In other words, if there is non-parallelity between any of said directions, the angle is below 75°.

According to one embodiment, the earth plane element is provided with recesses in the form of slots that separate the antenna element areas from each other and function electrically as open circuits.

According to one embodiment, the broadband antenna comprises a plurality of spacing elements, one for each antenna element and arranged between the respective antenna element and the earth plane element such that they separate a bottom surface of the antenna element from the earth plane element.

According to one embodiment, the spacing element for each antenna element is physically and electrically connected to a first conductor configured to form a first conductor extending in said third direction from the area of one neighbouring antenna element, and a second conductor configured to form a second conductor extending in said fourth direction from the area of a another neighbouring antenna element. Such design favours a rapid and automatic assembly of the broadband antenna. The principle itself is known through prior art, but not in combination with the teaching of the present invention as regards the differences between the first and third directions and second and fourth directions respectively.

According to one embodiment, spacing elements of neighbouring antenna elements are separated by a gap, and said first conductors and second conductors extend across such gaps in said third and fourth directions.

According to a preferred embodiment, each antenna element comprises a rotational-symmetrical body, the axis of rotation of each of said rotational-symmetrical bodies is essentially perpendicular to a main extension plane of said earth plane element, and each of said rotational-symmetrical bodies, at the end furthest away from the earth plane element, is shaped so that it tapers towards its axis of rotation with increasing distance from the earth plane element and is provided with a metallic casing surface. Thus, the antenna elements are so called BOR antenna elements.

According to one embodiment, each antenna element has an engagement means provided on a bottom surface of the antenna element and configured to be in engagement with a corresponding engagement means provided in the earth plane element or with any further component, such as the above-mentioned spacing element, positioned between the earth plane element and the antenna element and connected to the earth plane element.

According to one embodiment, the engagement means provided on the antenna element comprise a screw joint element that has a rotational axis which coincides with the axis of rotation of the rotational-symmetrical body. Thus, the engagement means may comprise a bolt that will engage a hole in the earth plane element or said further component, or it may comprise a hole in the bottom of the antenna element configured to receive a bolt extending from the earth plane element or from said further component. The diameter d of the engagement means compared to the diameter D of the base of the antenna element may be defined as $0.1D<d<0.8D$.

According to one embodiment, the engagement means provided on the antenna element is a bolt element provided with an outer threading, and the engagement means provided in the earth plane element or further component is a threaded hole.

According to one embodiment, the spacing element is a ring with a centre hole having a diameter which is equal to or larger than the diameter of said bolt element and which is penetrated by said bolt when the antenna element is attached to the earth plane element via said bolt element. Given that the bolt element engages the threading in a hole in the earth plane element, the spacing element is pressed to a fixed and stable position as a result of the engagement between the bolt element and the earth plane element.

Preferably, the antenna elements of the broadband group antenna are separated by a distance of not more than 1.0 Lambda, wherein Lambda is the wave length at the maximum operation frequency of the broadband group antenna.

According to one embodiment, the broadband antenna also comprises a microwave transceiver unit, configured to feed the plurality of antenna elements with microwave signals via said first and second conductors.

Further features of and advantages of the present invention will be presented in the following detailed description of an embodiment, with reference to the annexed drawing.

DETAILED DESCRIPTION

Figure 1:
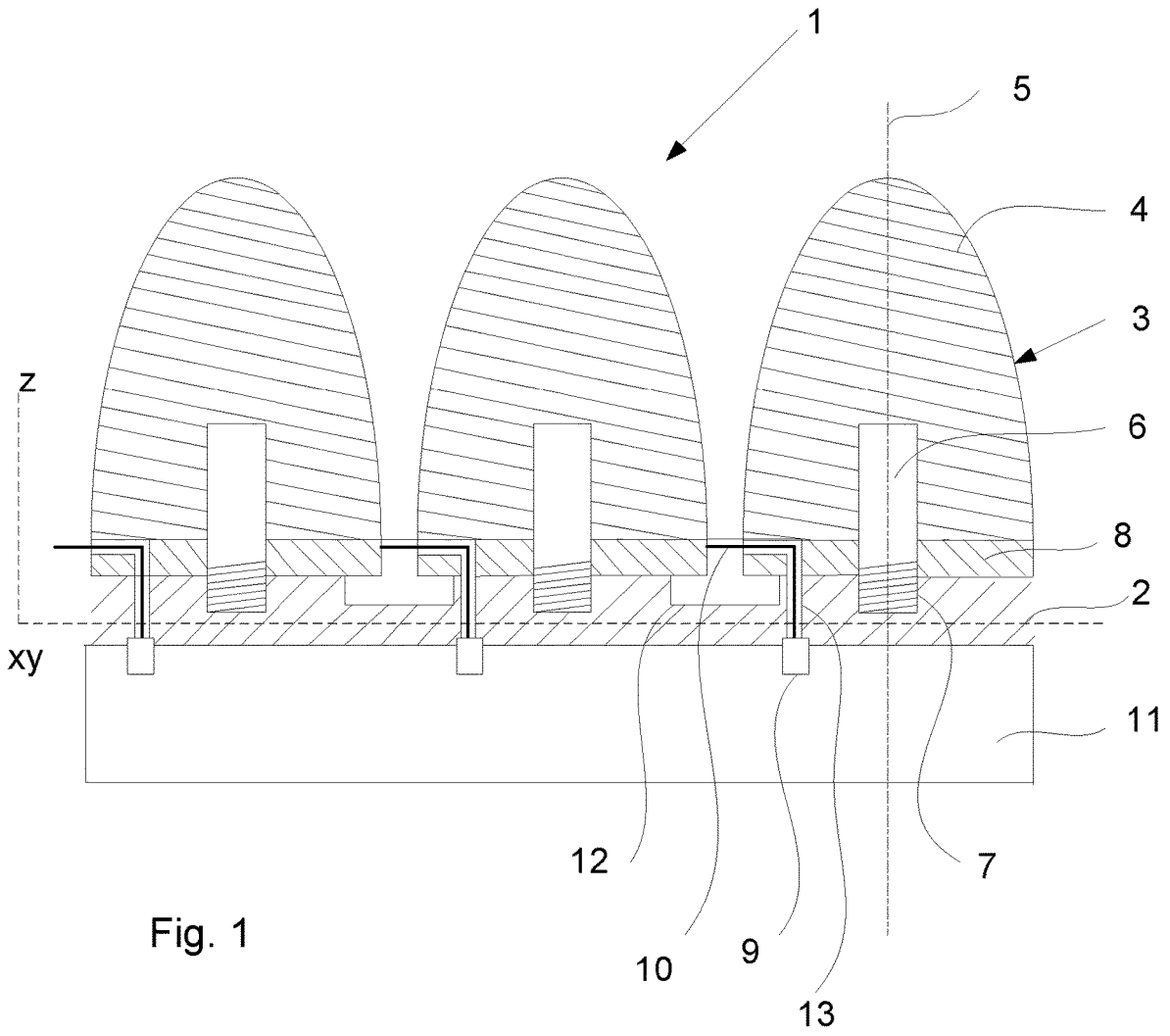
FIG. 1 is a cross section according to 1A-1A in FIG. 2 showing a part of a broadband antenna with conductor channels arranged in accordance with prior art.
Figure 2:
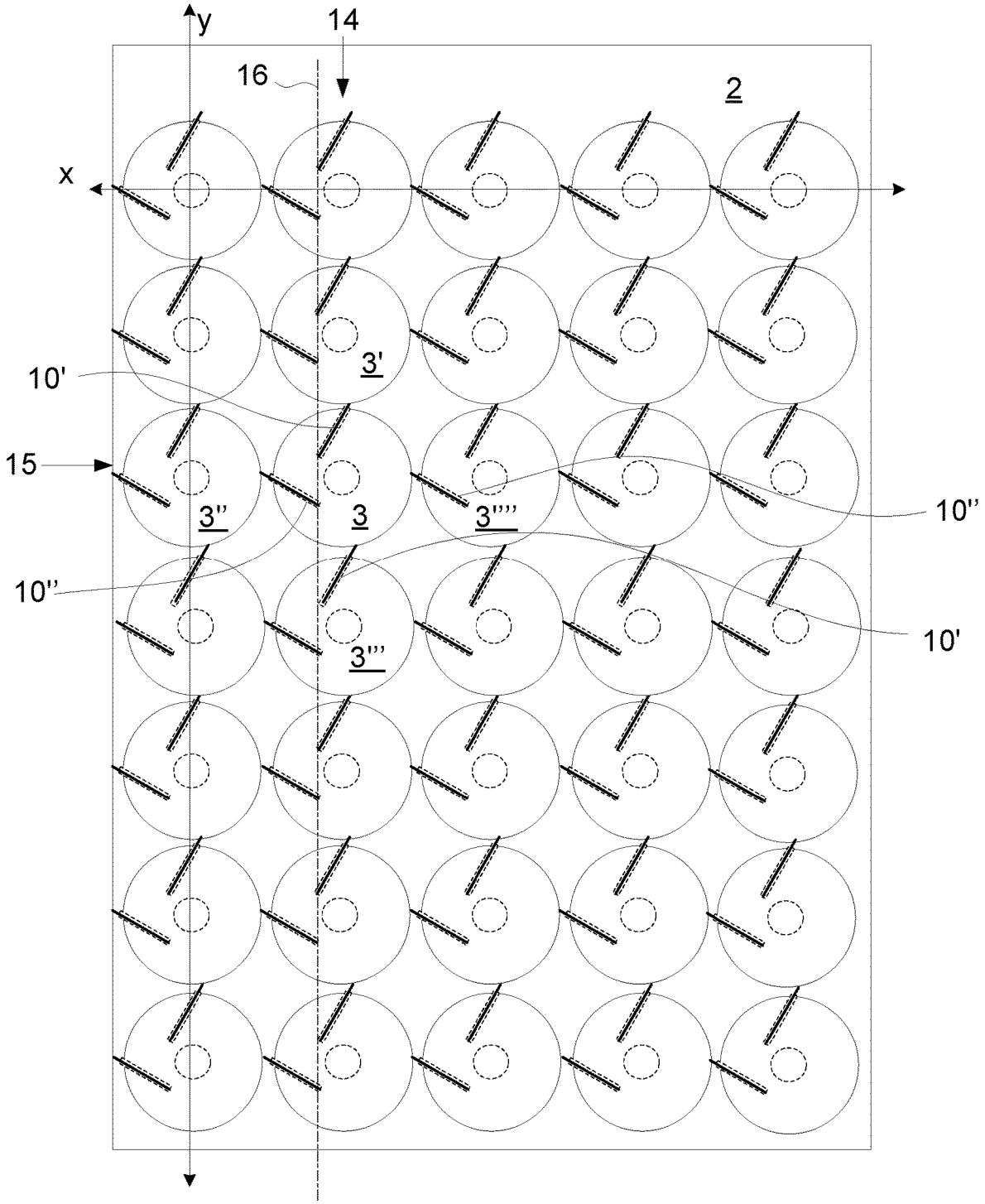
FIG. 2 is a view from above of a broadband group antenna according the present invention, with the antenna elements excluded.
Figure 3:
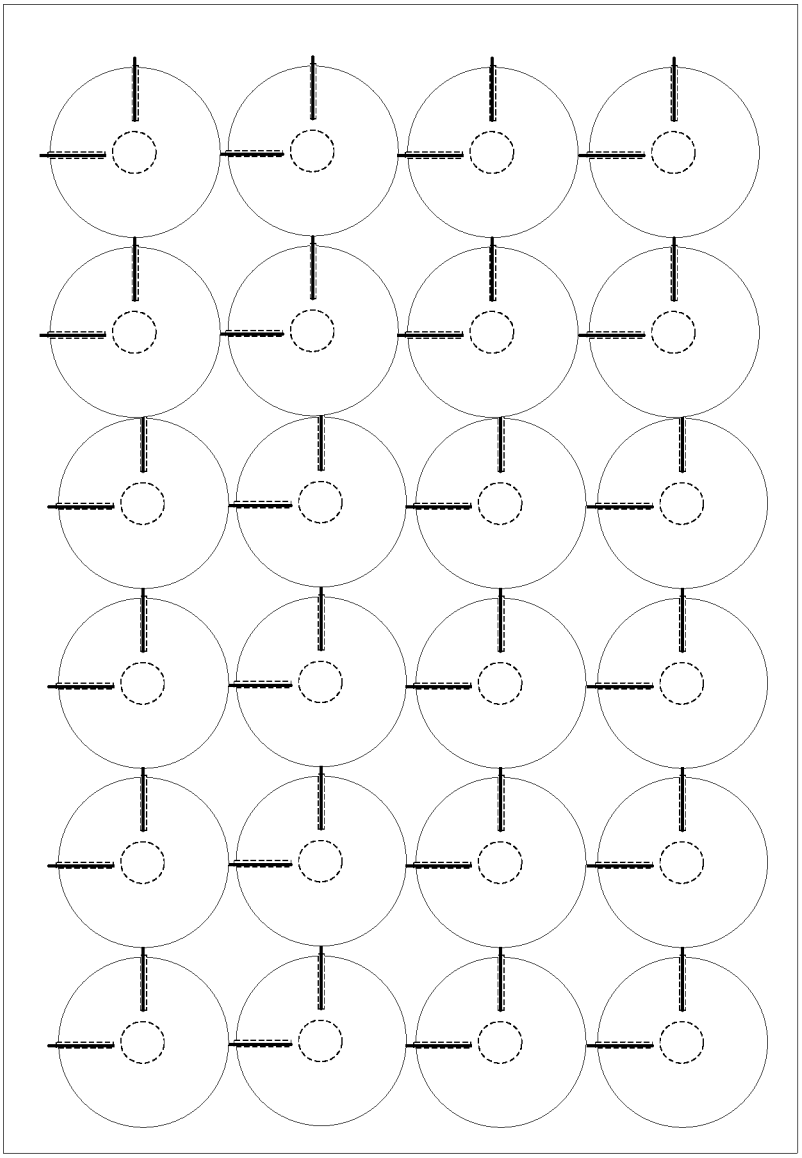
FIG. 3 is a view from above of broadband antenna group according to prior art, with the antenna elements excluded.

FIGS. 1 and 3 show a part of broadband antenna which has its feeding conductors arranged in accordance with the principles of prior art. FIG. 2 shows a broadband antenna that, as to its principal design, can be described by reference to FIG. 1 but that has its feeding conductors arranged according to the teaching of the present invention. FIG. 1 is thus not a perfect cross section taken through FIG. 2 due to the fact that the conductor arrangement in FIG. 2 is somewhat different. Still, FIG. 1 can be and will be used for defining the components that are present in the device according to the present invention as shown in FIG. 2.

The parts of a broadband antenna 1 shown in FIGS. 1 and 2 thus comprises an earth plane element 2, here formed by an aluminium-based alloy, on which antenna elements 3 are arranged in first rows 14 and second rows 15 that are perpendicular to each other. Each of the antenna elements 3 comprises a rotationally-symmetrical body 4 with an axis of symmetry 5 which also forms an axis of rotation of the antenna element 3. The ratio between the height and the width of an antenna element 3 can vary from case to case but is preferably in the range of 1:1 to 6:1. The rotationally-symmetrical body 4 may be a homogenous body of metallic material or a hollow body having a metallic shell or casing. The rotationally symmetric body 4 tapers towards an end which is remote from a bottom surface of the antenna element 3 which is turned towards the earth plane element 2.

The antenna elements 3 of the broadband group antenna 1 are separated by a distance of not more than 1.0 Lambda, wherein Lambda is the wave length at the maximum operation frequency of the broadband group antenna.

Each antenna element 3 further comprises an engagement means 6 by means of which it is connected to the earth plane element 2. In the embodiment shown, the engagement means 6 comprises a bolt element 6 provided with an outer threading. There is provided a corresponding hole 7 in the earth plane element 2. The hole 7 has an outer threading, such that a screw joint is achieved as the bolt element 6 is screwed into the hole 7.

Between a bottom surface of the rotationally-symmetrical body 4 of each antenna element 3 and the earth plane element 2 there is provided a metallic spacing element 8 which will be more described in detail later and which differs between prior art and the present invention. The spacing element 8 comprises a ring with a centre hole through which the bolt element 6 extends into the underlying earth plane element 2. The spacing element 8 is clamped between the antenna element 3 and the earth plane element 2 and is in electric contact with both the antenna element 3 and the earth plane element 2.

On a bottom surface at the back side of the earth plane element 2 there are provided contacts 9 for the connection of conductors 10 for the feeding of the antenna elements 3 to a microwave transceiver unit 11.

The earth plane element 2 is provided with recesses 12 in the form of slots that separate the antenna element areas from each other and function electrically as open circuits.

Accordingly, an electrically controlled broadband group antenna 1 according to the invention and as shown in FIGS. 1 and 2 comprises a plurality of antenna elements 3 and an earth plane element 2. The plurality of antenna elements 3 are arranged in a common plane on top of the earth plane element 2 and configured to be electrically connected to a microwave transceiver unit 11 via conductors 10 provided in channels 13 that extend through the earth plane element 2 in a direction perpendicular to a main extension plane xy of the earth plane element 2. The antenna elements 3 are arranged in a matrix pattern comprising first rows 14 extending in a first direction y and second rows 15 extending in a second direction x perpendicular to said first direction y, wherein the antenna elements 3 are in alignment with each other in said first rows 14 and in said second rows 15. From an area of each of a plurality of antenna elements 3 of one first row 14 there is provided a first conductor 10' that extends from a bottom side of the earth plane element 2 through a first of said channels 13, and continues in a third direction parallel to the main extension plane xy of earth plane element 2 to an area of a first neighbouring antenna element 3' belonging to the same first row 14 as each of said plurality of antenna elements, for the feeding of that neighbouring antenna element 3', and a second conductor 10" that extends from a bottom side of the earth plane element 2 through a second of said channels 13, and continues in a fourth direction parallel to the main extension plane xy of earth plane element 2 to an area of a second neighbouring antenna element 3" belonging to the same second row 15 as the antenna element 3 from which the first and second conductors 10', 10" extend, for the feeding of that second antenna element 3".

As can be seen in FIG. 2, the third and fourth directions, indicated by the extension direction of the first and second conductors 10' and 10" respectively, are non-parallel with the first and second directions y, x. Moreover, the first and second channels 13 via which the first and second conductors 10', 10" of each of said plurality of antenna elements 3 of said one first row 14 are configured to be connected to the microwave transceiver unit 11 are in alignment with each other along a line which is indicated with 16 and which is parallel with said first direction y. As a result thereof, the contacts 9 to which these first and second conductors 10', 10" are connected on the back side of the earth plane element 2 are also in alignment with each other and parallel with the first direction y. Corresponding contacts of the transceiver unit 11 are therefore also arranged in alignment with other, resulting in a thinner transceiver unit 11.

As a contrast thereto, in the broadband group antenna shown in FIG. 3, showing prior art, the third and fourth directions are parallel with the first and second directions y, x respectively. Thereby the first and second channels are not in alignment with each other and the contacts on the back side of the earth plane element will form a zigzag pattern. Thereby, a microwave transceiver unit to be connected thereto has to present contacts with a corresponding zigzag pattern.

In the embodiment shown in FIG. 2, the angle between the third direction and the fourth direction is approximately 90°. Other angles are conceivable. The angle between the first direction y and the third direction is approximately 30°. However, alternative other angles between the first direction y and the third direction are conceivable, for example 45°.

Figure 4:
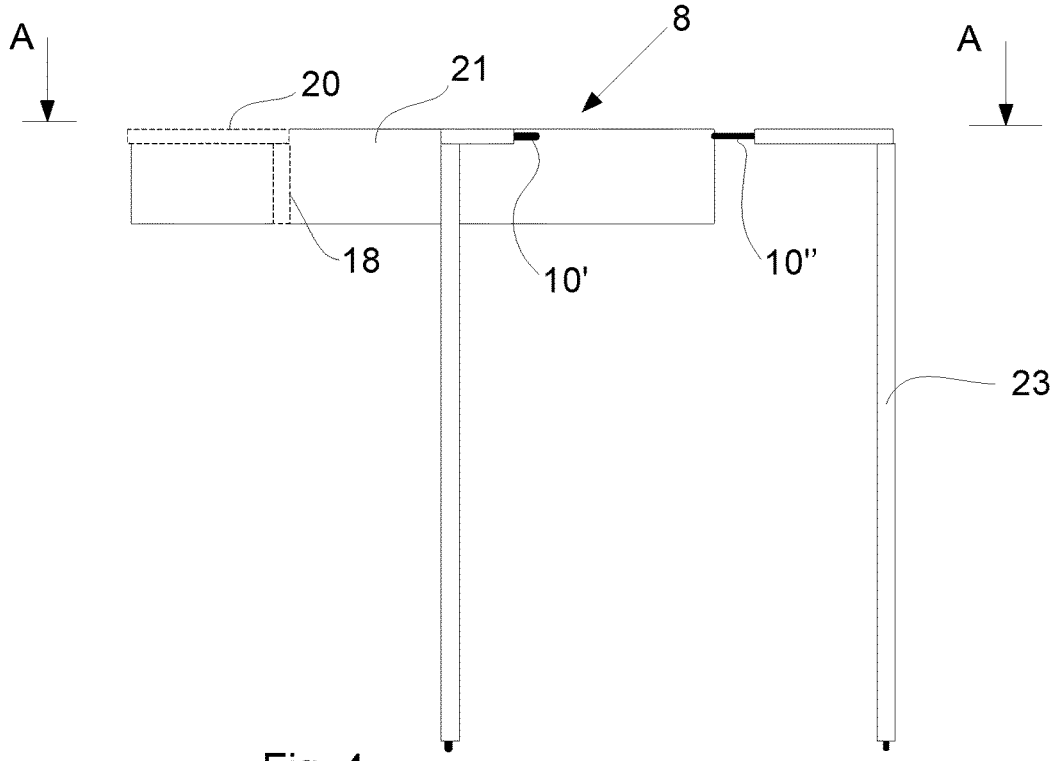
FIG. 4 is a side view of a spacing element according to the present invention.
Figure 5:
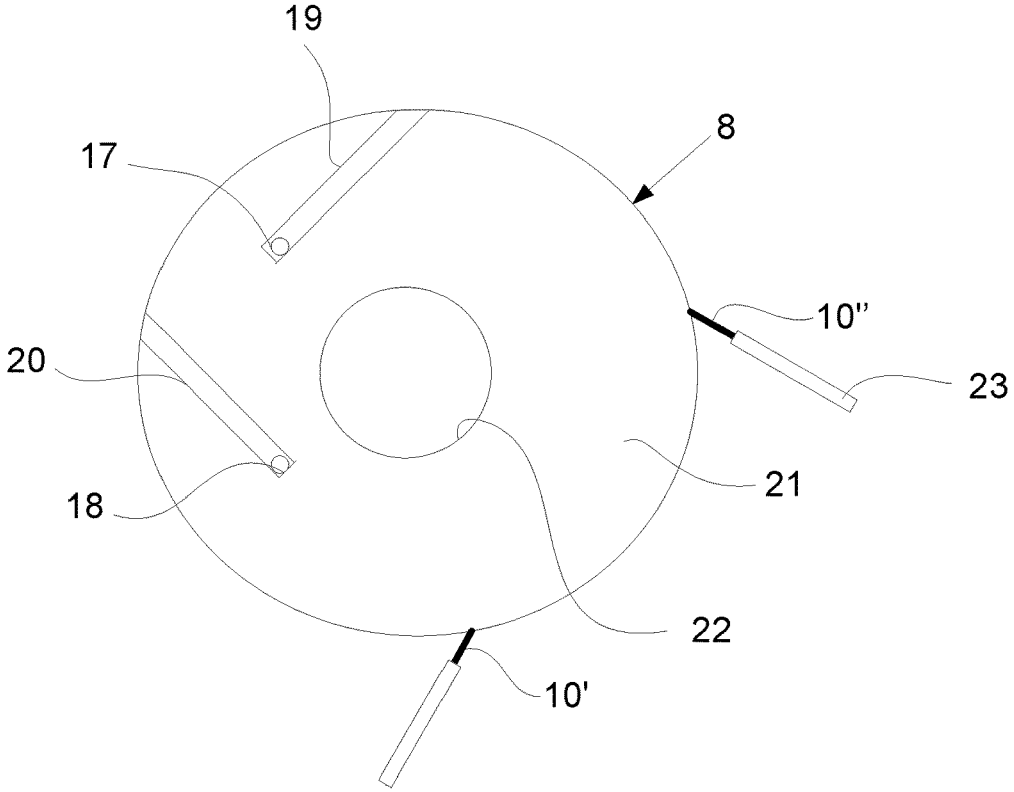
FIG. 5 is a view according to A-A in FIG. 4, and FIGS. 6-8 are examples of alternative arrangements of conductors extending from the area of one antenna elements towards neighbouring antenna elements in third and fourth directions.

Reference is now made to FIG. 2 and FIGS. 4-5. Each spacing element 8, possibly with the exception of the spacing elements 8 that belong to antenna elements 3 that form peripheral rows of antenna elements 3 in the array of antenna elements, comprises two holes 17, 18, which are in alignment with the channels 13 through which the first and second conductors 10', 10" extend through the earth plane element 2 in the area of a specific antenna element 3. From the opening of each of said holes 17, 18, there is a provided a groove 19, 20 in the upper surface of spacing element 8 in said third and fourth directions respectively. The conductors 10', 10" extending through said holes 13 and 17, 18 are redirected such that they will extend in said grooves 19, 20 and further to the neighbouring antenna element 3', 3" that they are configured to feed. In the array of antenna elements 3, the spacing elements 8 of neighbouring antenna elements 3 are separated by a gap and the first conductors 10' and the second conductors 10" extend across such gaps in said third and fourth directions.

Each spacing element 8 is physically and electrically connected to a first conductor 10' configured to form a first conductor 10' extending in said third direction from the area of one neighbouring antenna element 3'" belonging to the same first row as the antenna element 3 carrying the spacing element 8 in question, and a second conductor 10" configured to form a second conductor 10" extending in said fourth direction from the area of another neighbouring antenna element 3"" belong to the same second row 15 as the antenna element 3 carrying the spacing element 8 in question.

The conductors 10', 10" comprise coaxial cables having an outer electrically isolating shield, which is indicated with 23 in FIGS. 4 and 5 and prevents electrical contact between the inner conductor 10', 10" and the earth plane element 2 in said channels 13, holes 17, 18 and grooves 19, 20 that the respective conductor 10', 10" passes through on its way from the spacing element 8 to the contact 9 through which it is connected to the microwave transceiver unit 11. The spacing element also comprises a centre hole 22, which is parallel with the hole 7 in the earth plane element 2 when the spacing element 8 is positioned on the latter. The diameter of said centre hole 22 is approximately the same as the diameter of the hole 7 in the earth plane element 2 and corresponds to the diameter of the bolt element 6 provided on the antenna element 3 to be positioned on the spacing element 8.

FIGS. 6-9 are examples of alternative arrangements of conductors extending from the area of one antenna element towards neighbouring antenna elements in third and fourth directions. The first and second directions are indicated y and x respectively.

Figure 6:
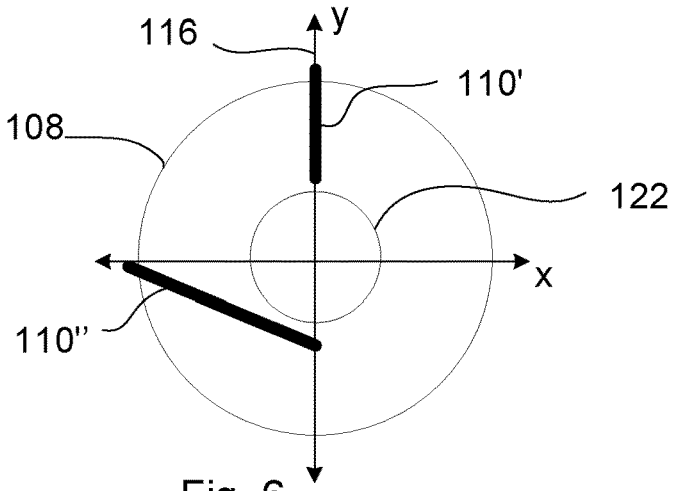

FIG. 6 shows an embodiment in which the first direction y and the third direction are parallel, while the second direction x and fourth direction are non-parallel. The channels through which the first conductor 110' and the second conductor 110" extend through the earth plane element are in alignment along a line 116 that is parallel with the first direction y. The outer periphery of a spacing element 108 is indicated as well as the periphery of a centre hole 122 that has a diameter corresponding to the diameter of a bolt element by means of which an antenna element is connected to said earth plane element.

Figure 7:
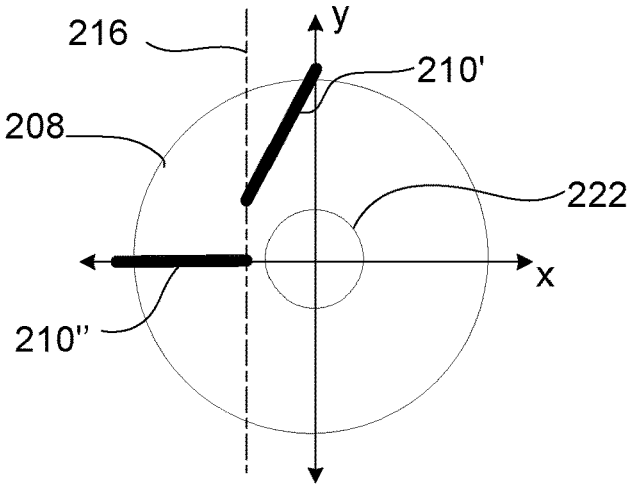

FIG. 7 shows an embodiment in which the third direction is non-parallel with the first direction y, while the second direction x is parallel with the fourth direction. The channels through which the first conductor 210' and the second conductor 210" extend through the earth plane element are in alignment along a line 216 that is parallel with the first direction y. The outer periphery of a spacing element 208 is indicated as well as the periphery of a centre hole 222 that has a diameter corresponding to the diameter of a bolt element by means of which an antenna element is connected to said earth plane element.

Figure 8:
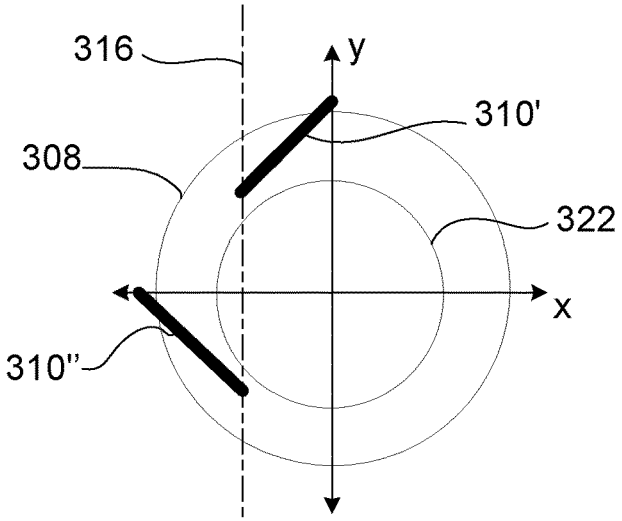

FIG. 8 shows an embodiment in which the third direction is non-parallel with the first direction y and the fourth direction is non-parallel with the second direction y. The outer periphery of a spacing element 308 is indicated as well as the periphery of a centre hole 322 that has a diameter corresponding to the diameter of a bolt element by means of which an antenna element is connected to said earth plane element. The diameter of the centre hole 322, in relation to the diameter of the spacing element, is larger than in the previous embodiments shown. The channels through which the first conductor 310' and the second conductor 310" extend through the earth plane element are in alignment along a line 316 that is parallel with the first direction y. A thick bolt element will result in a large centre hole 322. If the conductor channels are to be in alignment in the first direction, the angles between the first direction and the third direction and between the second direction and the fourth direction have to be rather large as the centre hole is larger and occupies a larger part of the area available for the channels. Thus, in the case of a relatively thick bolt element, the advantages of the invention become even larger compared to prior art.

The invention claimed is:

1. An electrically controlled broadband group antenna, comprising a plurality of antenna elements and an earth plane element, wherein the plurality of antenna elements are arranged in a common plane on top of the earth plane element and configured to be electrically connected to a microwave transceiver unit via conductors provided in channels that extend through the earth plane element in a direction perpendicular to a main extension plane of the earth plane element, the antenna elements are arranged in a matrix pattern comprising first rows extending in a first direction and second rows extending in a second direction perpendicular to said first direction, wherein the antenna elements are in alignment with each other in said first rows and in said second rows, and wherein, from an area of each of a plurality of antenna elements of one first row there is provided a first conductor that extends from a bottom side of the earth plane element through a first of said channels, and continues in a third direction parallel to the main extension plane of earth plane element to an area of a first neighbouring antenna element belonging to the same first row as each of said plurality of antenna elements, for the feeding of that neighbouring antenna element, and a second conductor that extends from a bottom side of the earth plane element through a second of said channels, and continues in a fourth direction parallel to the main extension plane of earth plane element to an area of a second neighbouring antenna element belonging to the same second row as the antenna element from which the first and second conductors extend, for the feeding of that second antenna element, wherein the earth plane element is provided with recesses in the form of slots that separate the antenna element areas from each other and function electrically as open circuits, wherein at least one of the third and fourth directions is non-parallel with the first and second directions respectively, and that the first and second channels via which the first and second conductors of each of said plurality of antenna elements of said one first row are configured to be connected to a microwave transceiver unit are in alignment along a line which is parallel with said first direction, wherein spacing elements of neighbouring antenna elements are separated by a gap and that said first conductors and second conductors extend across such gaps in said third and fourth directions.

2. The broadband group antenna according to claim 1, wherein the angle between the first direction and the third direction and/or between the second direction and the fourth direction is at least 5°.

3. The broadband group antenna according to claim 1, wherein the angle between the first direction and the third direction and/or between the second direction and the fourth direction is below 75°.

4. The broadband group antenna according to claim 1, further comprising a plurality of spacing elements, one for each antenna element and arranged between the respective antenna element and the earth plane element such that they separate a bottom surface of the antenna element from the earth plane element.

5. The broadband group antenna according to claim 4, wherein the spacing element for each antenna element is physically and electrically connected to the first conductor configured to form the first conductor extending in said third direction from the area of one neighbouring antenna element, and the second conductor configured to form the second conductor extending in said fourth direction from the area of a another neighbouring antenna element.

6. The broadband group antenna according to claim 1, wherein each antenna element comprises a rotational-symmetrical body, the axis of rotation of each of said rotational-symmetrical bodies is essentially perpendicular to a main extension plane of said earth plane element, and that each of said rotational-symmetrical bodies, at the end furthest away from the earth plane element, is shaped so that it tapers towards its axis of rotation with increasing distance from the earth plane element and is provided with a metallic casing surface.

7. The broadband group antenna according to claim 1, wherein each antenna element has an engagement means provided on a bottom surface of the antenna element and configured to be in engagement with a corresponding engagement means provided in the earth plane element or with any further component positioned between the earth plane element and the antenna element and connected to the earth plane element.

8. The broadband group antenna according to claim 7, wherein the engagement means provided on the antenna element comprise a screw joint element that has a rotational axis which coincides with the axis of rotation of the rotational symmetrical body.

9. The broadband group antenna according to claim 8, wherein the engagement means provided on the antenna element is a bolt element provided with an outer threading and that the engagement means provided in the earth plane element or further component is a threaded hole.

10. The broadband group antenna according to claim 4, wherein the spacing element is a ring with a centre hole having a diameter which is equal to or larger than the diameter of said bolt element and which is penetrated by said bolt element when the antenna element is attached to the earth plane element via said bolt element.

11. The broadband group antenna according to claim 1, wherein the antenna elements are separated by a distance of not more than 1.0 Lambda, wherein Lambda is the wave length at the maximum operation frequency of the broadband group antenna.

12. The broadband group antenna according to claim 1, further comprising a microwave transceiver unit, configured to feed the plurality of antenna elements with microwave signals via said first and second conductors.

* * * * *